US006505709B1

(12) United States Patent
Massé

(10) Patent No.: US 6,505,709 B1
(45) Date of Patent: Jan. 14, 2003

(54) SLEIGH SHAPED DEVICE FOR MINING RAISES

(75) Inventor: Roger F. Massé, Val d'Or (CA)

(73) Assignee: Machines Roger International Inc., Val d'Or (CA)

( * ) Notice: Subject to any disclaimer, the term of this patent is extended or adjusted under 35 U.S.C. 154(b) by 0 days.

(21) Appl. No.: 09/688,219

(22) Filed: Oct. 16, 2000

(51) Int. Cl.[7] ..... E04G 1/18; A62B 9/04
(52) U.S. Cl. ..... 182/145; 280/845
(58) Field of Search ..... 280/845, 24, 28; 182/141, 142, 145, 148, 150

(56) References Cited

U.S. PATENT DOCUMENTS

| | | | | | |
|---|---|---|---|---|---|
| 1,130,786 | A | * | 3/1915 | Wirt | 280/845 |
| 2,232,643 | A | * | 2/1941 | Smith | 280/845 |
| 3,220,509 | A | * | 11/1965 | Fischer | 182/142 |
| 3,464,520 | A | * | 9/1969 | Anderson | 182/142 |
| 3,561,143 | A | * | 2/1971 | Lockhart | 280/28 X |
| 3,785,454 | A | * | 1/1974 | Behunin et al. | 182/145 X |
| 3,863,736 | A | * | 2/1975 | Mc Williams | 182/142 |
| 3,907,066 | A | * | 9/1975 | Newton | 182/142 |
| 3,931,868 | A | * | 1/1976 | Smith, Jr. | 182/145 X |
| 4,347,913 | A | * | 9/1982 | Cromer, Jr. | 182/142 |
| 4,422,528 | A | * | 12/1983 | Patterson | 182/145 |
| 4,593,789 | A | * | 6/1986 | Treants | 182/142 |
| 4,650,035 | A | * | 3/1987 | Eubanks | 182/145 X |
| 5,022,489 | A | * | 6/1991 | Sauber | 182/145 X |
| 5,205,570 | A | * | 4/1993 | Brown | 280/24 |
| 5,306,026 | A | * | 4/1994 | Jesse | 280/24 X |
| 5,494,132 | A | * | 2/1996 | Hansen | 182/142 X |

FOREIGN PATENT DOCUMENTS

| | | |
|---|---|---|
| DE | 3700027 | 7/1988 |
| DE | 3840747 | 6/1990 |

* cited by examiner

*Primary Examiner*—Daniel P. Stodola
*Assistant Examiner*—Hugh B. Thompson
(74) *Attorney, Agent, or Firm*—Robic

(57) ABSTRACT

A sleigh-shaped device, having a longitudinal axis and a transverse axis, for use in a mining raise. The sleigh-shaped device has a base frame for sliding along the mining raise in a direction parallel to the longitudinal axis, the base frame having a bottom surface with sliding runners extending parallel to the longitudinal axis, and a top surface having front and rear opposite ends. The device also has a tiltable platform pivotally mounted to the top surface of the base frame between the front and rear ends about a first axis parallel to the transverse axis, and platform adjusters cooperating with the base frame and the tiltable platform for adjusting the tiltable platform with respect to the base frame. The device further has connecters for anchoring the base frame to a pulley system to provide movement of the sleigh-shaped device along the mining raise, the front and of the base frame extending below the rear end of the same during movement of the sleigh-shaped device along the mining raise. The sleigh-shaped device comprises various adjustable features enabling the device to adapt itself to the particular geometric configurations of various types of mining raises. The device includes an ergonomic stand structure allowing a user to operate a tool for carrying out tasks along the raise with little effort. The device enables top to bottom sequence of work along the raise. It also offers a newer and safer approach to working in mining raises and includes various safety features in order to not only provide better performance, but also greater safety to its users.

17 Claims, 11 Drawing Sheets

SLEIGH SHAPED DEVICE FOR MINING RAISES

FIELD OF THE INVENTION

The present invention relates to a device for use in a mining raise. More particularly, the invention relates to a sleigh-shaped device having an adjustable base frame anchored to a pulley system to provide sliding movement of the device along a mining raise.

BACKGROUND OF THE INVENTION

It is well known that underground excavations in rock are required for various civil engineering and mining applications. These excavations include shafts, ramps and raises. The shafts are substantially vertical and serve as main access from the surface to deep underground excavations. Raises are usually required as an access between underground levels or for other requirements, such as services or ventilation. Various labels are used to designate the raises depending on their use. For example, a "manway" is a raise used for personal access from level to level or for emergency evacuation. An "orepass" is a raise used for ore transport from a working level to the skip. A "wastepass" is a raise used for when waste rock needs to be evacuated from the working area. A "ventilation raise" is a raise used to provide air supply or exhaust in the underground openings. These different types of raises can have various dipping angles ranging from 45 to 90 degrees. Furthermore, both the shape and the size of their cross-section may vary. Therefore, it would be useful to provide a device which comprises various adjustable features enabling the device to adapt itself to the particular geometric configurations of various types of mining raises.

It is also known that, aside from actually digging the raise, ground support and/or equipment will have to be installed on the raise depending on its intended purpose (manway or any other of the aforementioned). Thus, once the excavation is done, various tasks are required to adapt the mine raise for its intended purpose. These tasks may be one or more of the following: scaling of the rock walls, rock bolting, installation of rails, installation of screens, covering the walls with shot-creet, installation of cables, duct or various utilities, and installation of ladders and guards. In order to do these various tasks, means have to be used to access the rock face in the raise. Therefore, it would be useful to provide a device which does not only give access to the rock face of the mining raise, but which also comprises an ergonomic stand structure allowing a workman to operate a tool for carrying out requested tasks along the raise with little effort.

Two of the most often used technologies for raise excavation and installation are, on the one hand, the Alimak™ raise climber and, on the other hand, the one known as the scaffolding construction (timbers or aluminum modules). In both cases, the excavation and installation progress from the bottom of the raise and proceeds upwards. Usually, the raise will be excavated using successive rounds of explosives (usually 8 feet). In the case of the Alimak™ technology, the work cycle includes installation of guiding rails to the rock face, drilling of the blast holes in the roof, blasting, scaling, ground support, and installation of rails to access the new roof. As a result thereof, the workmen are exposed to unsecured ground each time they have to travel up and down in the raise adding to the potential safety risk of this type of work. In the case of the scaffolding technology, either built from wood timbers or modular structures, the same risks exist. Therefore, it would be useful to provide a device which, instead of starting from the bottom of the raise and proceeding upwards, enables top to bottom sequence of work along the raise.

It is also known that the devices used for working in mining raises need to be very safe. Failure to do so may result in serious injuries or even death. A major problem inherent to the above-mentioned devices is that, as aforesaid, workmen are exposed to unsecured ground every time they have to travel up and down in the raise, adding to the potential safety risk of their work. In practice, the installation and mounting of a scaffolding or any similar type of structure which is raised up from the ground, is quite lengthy, cumbersome, difficult, and dangerous, especially when operating at precarious elevated heights. Furthermore, these types of structures do not allow the workmen to be equipped with adequate safety gear preventing them from falling. Moreover, it is also known that structures raised up from the ground, such as scaffoldings, become very unstable when they reach elevated heights. As a result of the above-mentioned problems inherent to the devices known in the art, it has been experienced that some workmen have fallen and have been seriously injured, either due to human error or to failure and/or improper operation of the devices. Therefore, it would be useful to provide a device which offers a newer and safer approach to working in mining raises and which comprises various safety features in order to provide not only better performance, but also greater safety to the users.

It is further known that most of the devices which are used for working in mining raises and are available in the trade, are quite elaborate and consist of various components which are intrinsically linked to one another. This makes these types of devices difficult to manufacture, assemble, maintain, and even repair. Furthermore, the above-mentioned devices tend to be bulky and heavy, making them difficult to move around from place to place inside the mine or even to ship to the mine itself. Therefore, it would be useful to provide a device which comprises a simple design and which is lightweight, thereby making it easier to manufacture, assemble, maintain, repair and/or move around.

SUMMARY OF THE INVENTION

The main objects of the present invention are to provide a device which satisfies each of the above-mentioned needs.

More particularly, a first object of the invention is to provide a device which comprises various adjustable features enabling the device to adapt itself to the particular geometric configurations of various types of mining raises.

A second object of the invention is to provide a device which gives not only access to the rock face of the mining raise, but which also comprises an ergonomic stand structure allowing a user to operate a tool for carrying out tasks along the raise with little effort.

A third object of the invention is to provide a device which, instead of being exclusively usable starting from the bottom of the raise and proceeding upwards, enables top to bottom sequence of work along the raise.

A fourth object of the invention is to provide a device which offers a newer and safer approach to working in mining raises and which comprises various safety features in order to not only provide better performance, but also greater safety to its users.

A fifth object of the invention is to provide a device which comprises a simple design and is lightweight, thereby making it easier to manufacture, assemble, maintain, repair and/or move around.

In accordance with the invention, the above objects are achieved by a sleigh-shaped device for use in a mining raise. This sleigh-shaped device has a longitudinal axis and a transverse axis, and comprises:

a base frame for sliding along the mining raise in a direction parallel to the longitudinal axis, said base frame having a bottom surface with sliding means extending parallel to the longitudinal axis, and a top surface having front and rear opposite ends;

a tiltable platform pivotally mounted to the top surface of the base frame between the front and rear ends about a first axis parallel to the transverse axis;

platform adjusting means cooperating with the base frame and the tiltable platform for adjusting the tiltable platform with respect to the base frame; and connecting means for anchoring the base frame to a pulley system to provide movement of the sleigh-shaped device along the mining raise, the front end of the base frame extending below the rear end of the same during movement of the sleigh-shaped device along the mining raise.

Preferably, the sleigh-shaped device further comprises:

a tiltable safety roof pivotally mounted to the top surface of the base frame between the rear end and the tiltable platform about a second axis parallel to the transverse axis, and safety roof adjusting means cooperating with the base frame and the tiltable safety roof for adjusting the tiltable safety roof with respect to the base frame.

Preferably also, the sleigh-shaped device further comprises:

a tiltable safety fence pivotally mounted to the bottom surface of the base frame between two runners of the sliding means about a third axis parallel to the transverse axis; and safety fence adjusting means cooperating with the base frame and the tiltable safety fence for adjusting the tiltable safety fence with respect to the base frame.

Preferably also, a first surface of the tiltable platform is provided with a tool for carrying out work in the mining raise, the tool being mounted on an ergonomic support, the ergonomic support being removably secured to the first surface of the platform.

The invention and its advantages will be better understood by reading the following non-restrictive description of a preferred embodiment thereof, made with reference to the accompanying drawings.

DETAILED DESCRIPTION OF A PREFERRED EMBODIMENT OF THE INVENTION

Figure 1:
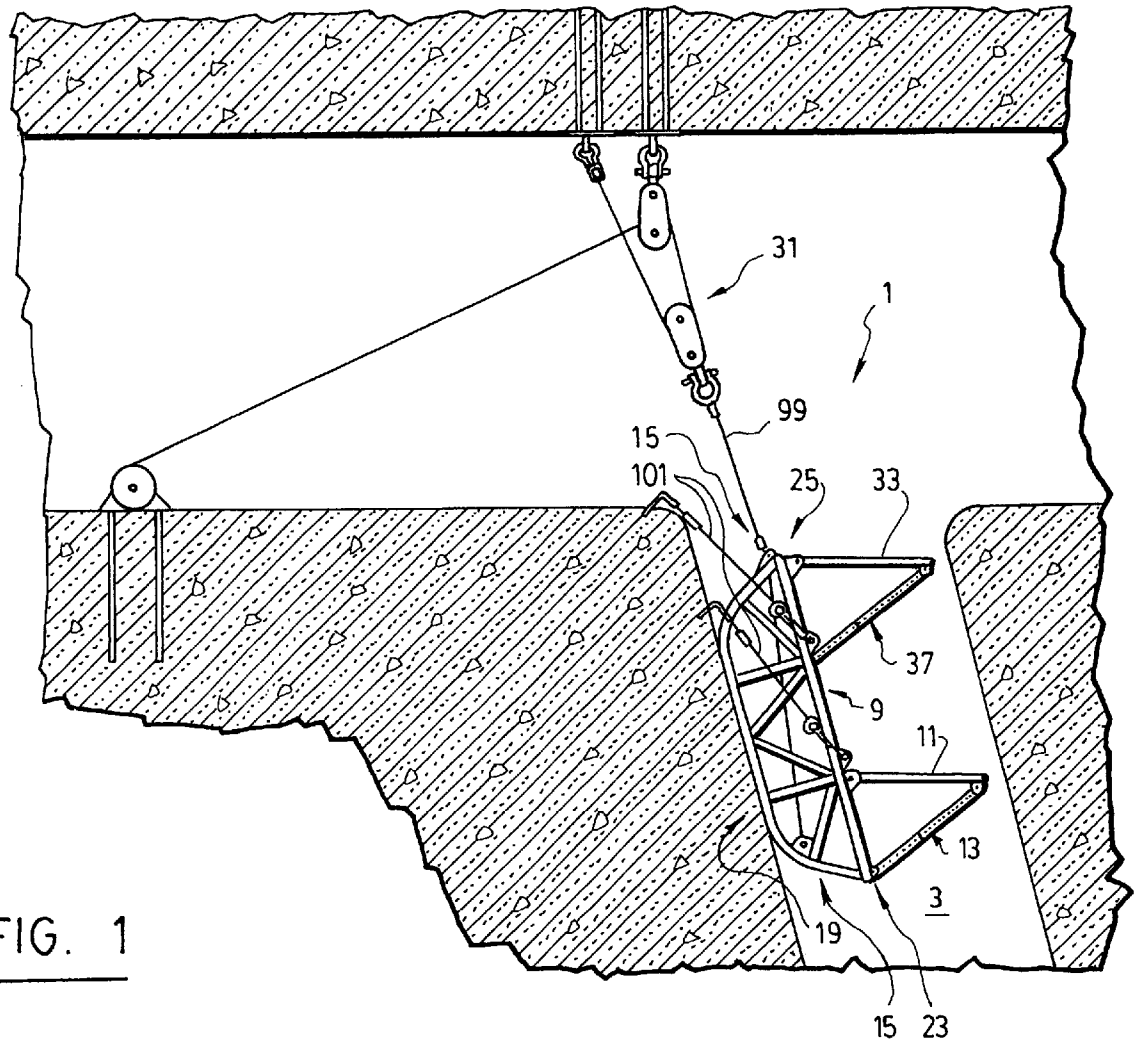
FIG. 1 is a side view of the upper portion of a mining raise in which extends a sleigh-shaped device according to a preferred embodiment of the invention, the device being shown anchored to a pulley system which provides movement of the device along the raise.

It is worth mentioning that, in the following description, the same numerical references have been used to identify the same structural elements.

It is also worth mentioning that, although the present invention is concerned with a sleigh-shaped device, which is primarily designed to be used by human beings in a mining raise, it should be understood that, in the context of the present description, expressions such as "users", "workmen", etc. should not be interpreted to limit the scope of the present invention and thus to exclude other persons or objects with which the present invention could be used.

It is further worth mentioning that, although the present invention is referred to as a "sleigh-shaped" device, primarily due to the fact that a preferred embodiment of the base frame is shaped like a "sleigh", it should be understood that, in the context of the present description, the expression "sleigh-shaped" should not be taken in a restrictive sense to limit the scope of the invention since other embodiments for the base frame could be used with the invention, as will described hereinafter and will be apparent to a person skilled in the art.

The sleigh-shaped device 1 according to the preferred embodiment of the invention shown in the accompanying drawings is a device 1 for use in a mining raise 3. The sleigh-shaped device 1 has a longitudinal axis 5 and a transverse axis 7, and it comprises a base frame 9, a tiltable platform 11, platform adjusting means 13, and connecting means 15. The base frame 9 is devised for sliding along the mining raise 3 in a direction parallel to the longitudinal axis 5, and has a bottom surface 17 with sliding means 19 extending parallel to the longitudinal axis 5 and a top surface 21 having front and rear opposite ends 23, 25. The tiltable platform 11 is pivotally mounted to the top surface 21 of the base frame 9 between the front and rear ends 23, 25 about a first axis 27 parallel to the transverse axis 7. The platform adjusting means 13 cooperate with the base frame 9 and the tiltable platform 11 for adjusting the tiltable platform 11 with respect to the base frame 9. The connecting means 15 are devised for anchoring the base frame 9 to a pulley system 31 to provide movement of the sleigh-shaped device 1 along the mining raise 3, the front end 23 of the base frame 9 extending below the rear end 25 of the same during movement of the sleigh-shaped device 1 along the mining raise 3, as better shown in FIG. 1.

Figure 2:
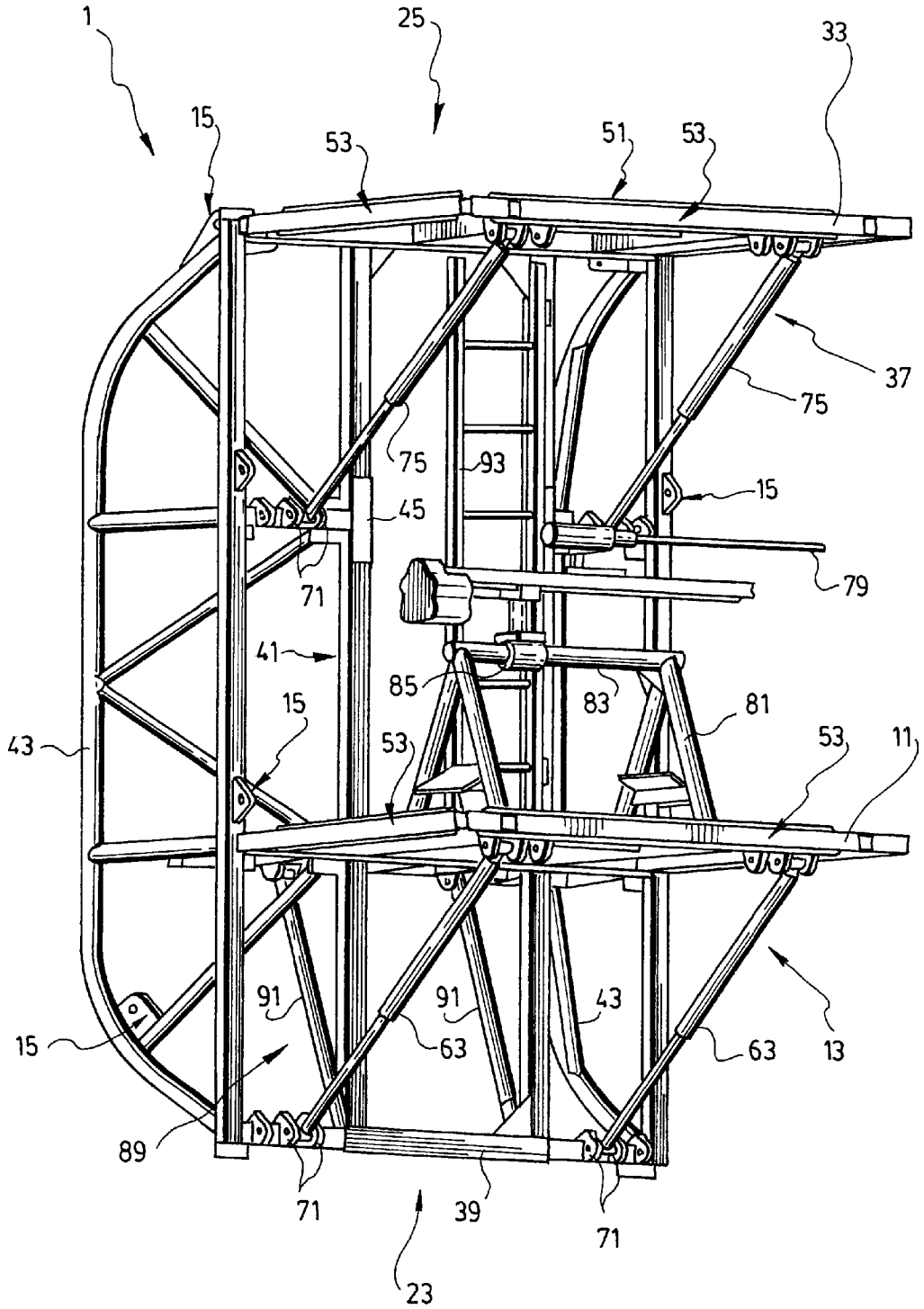
FIG. 2 is a perspective view of the sleigh-shaped device shown in FIG. 1, said device being shown with an ergonomic stand and tool mounted thereon.
Figure 3:
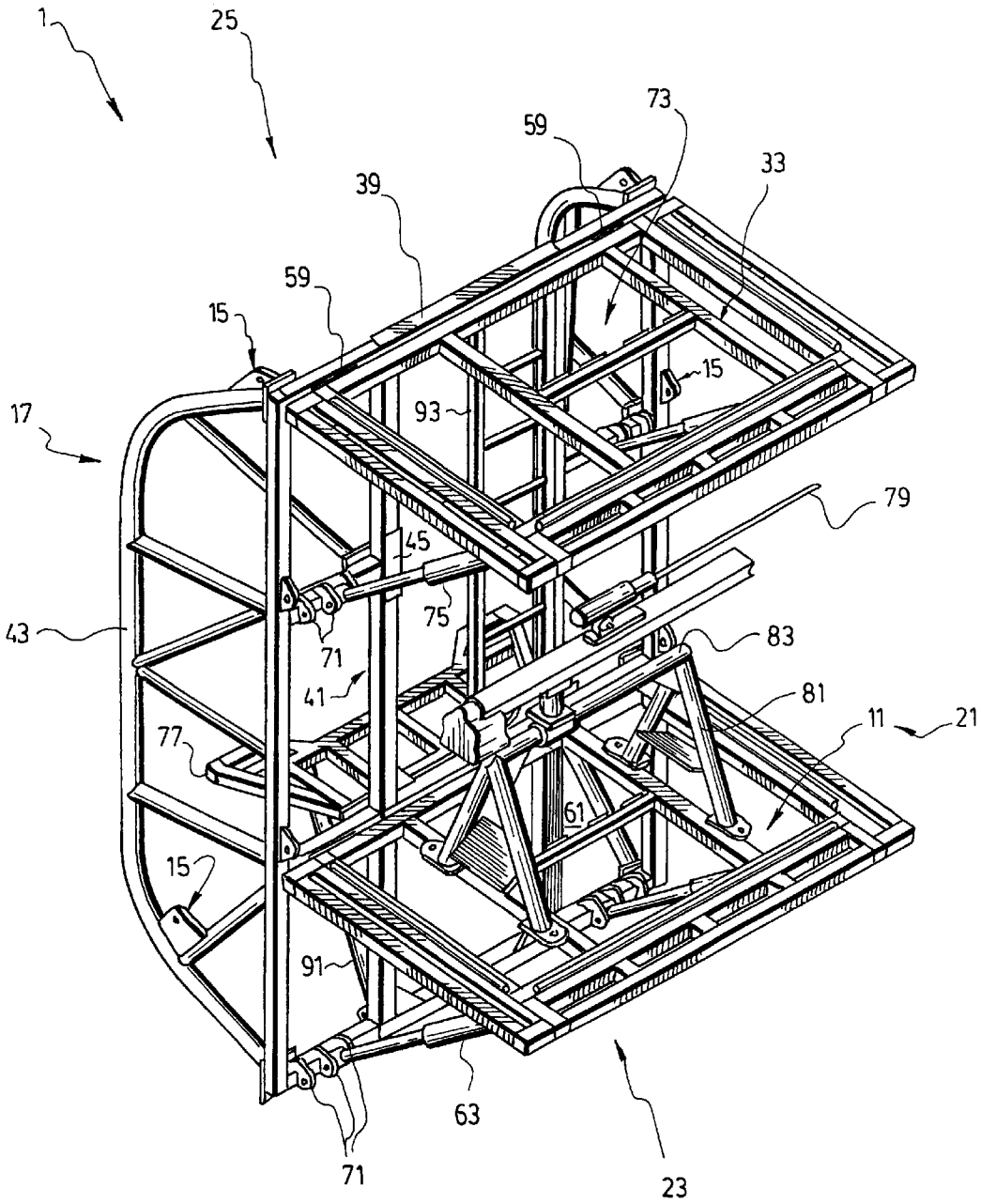
FIG. 3 is another perspective view of the sleigh-shaped device shown in FIG. 2.
Figure 4:
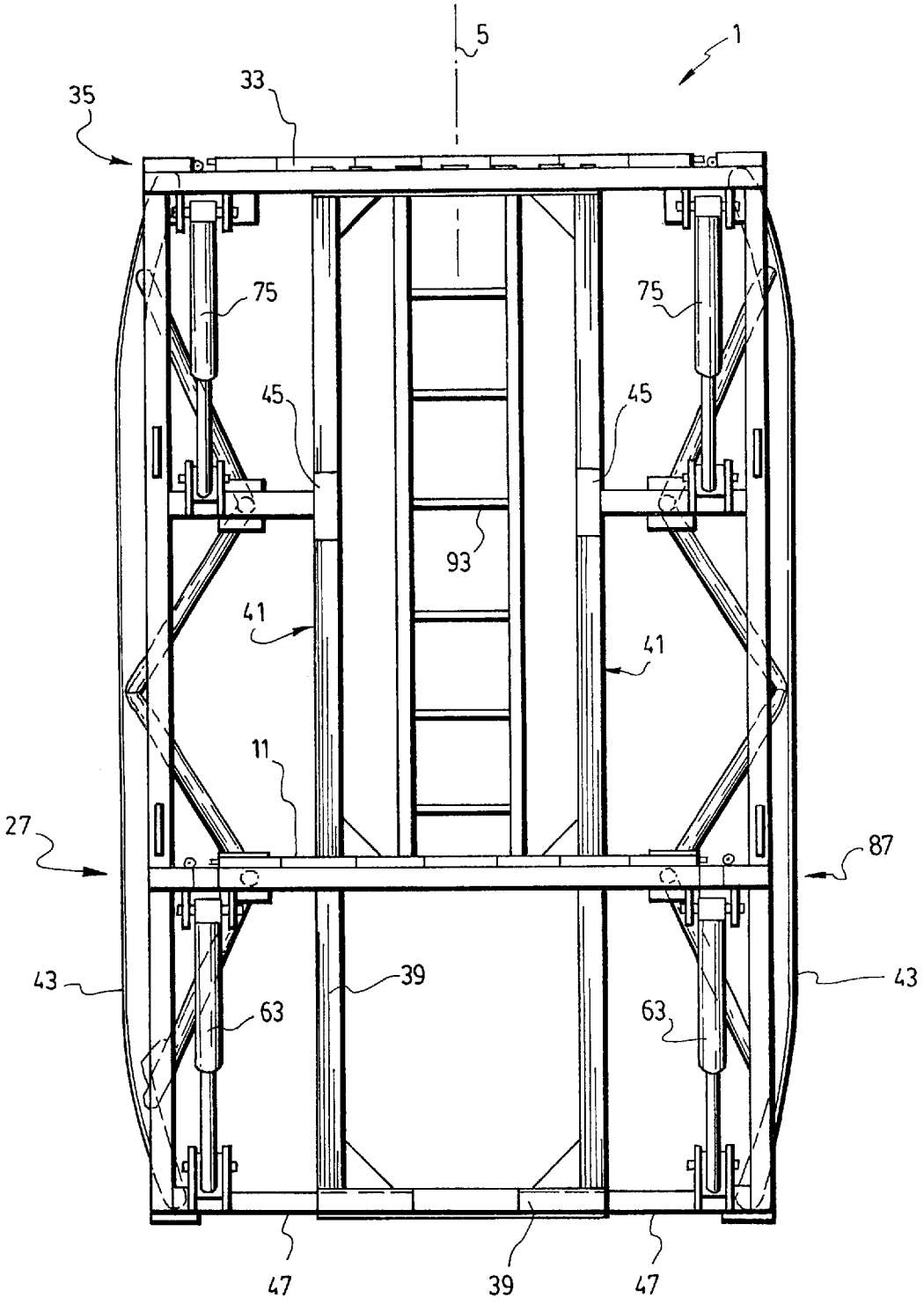
FIG. 4 is a top plan view of the sleigh-shaped device shown in FIG. 1.
Figure 5:
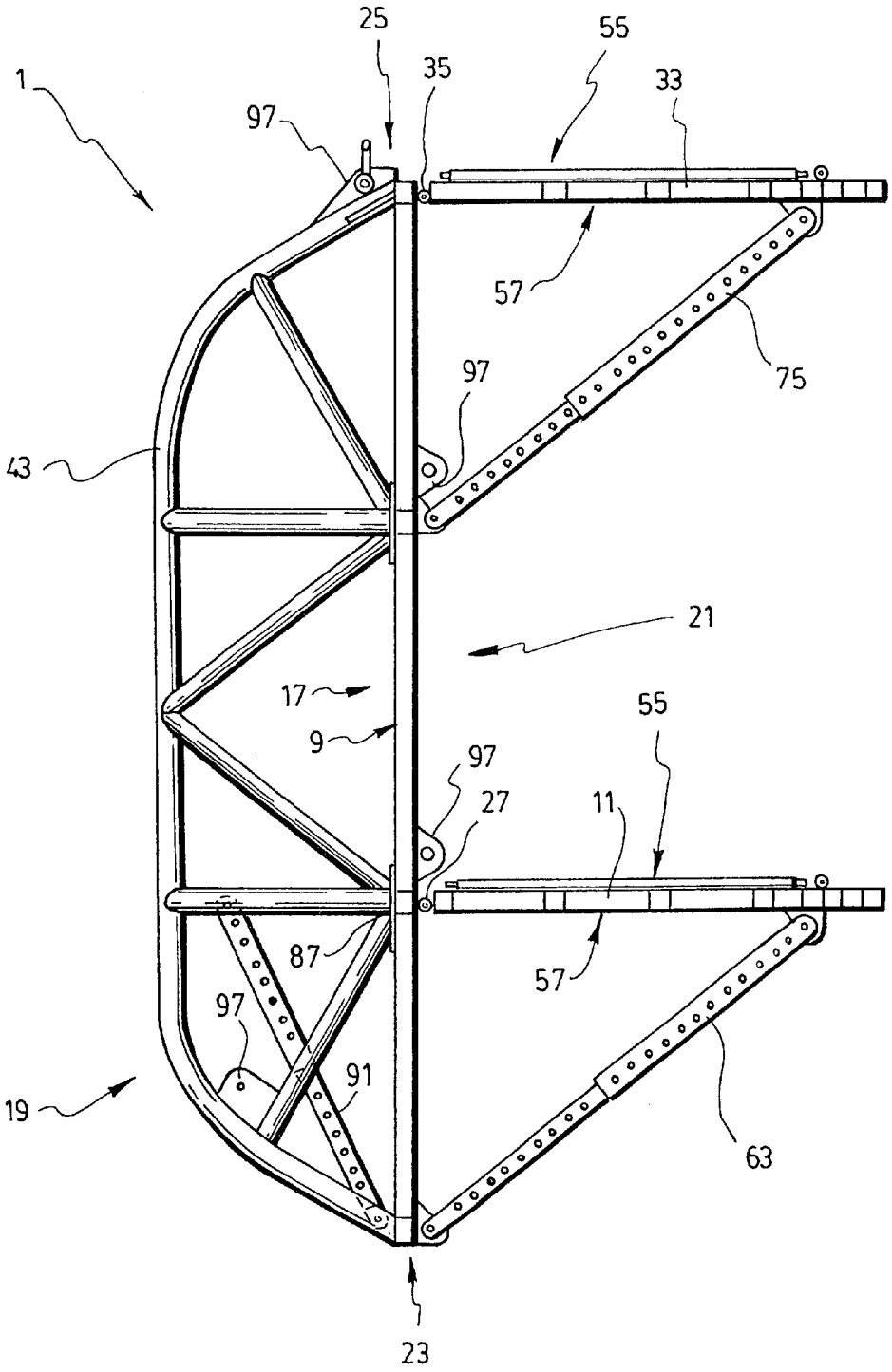
FIG. 5 is a side elevational view of the sleigh-shaped device shown in FIG. 1.
Figure 6:
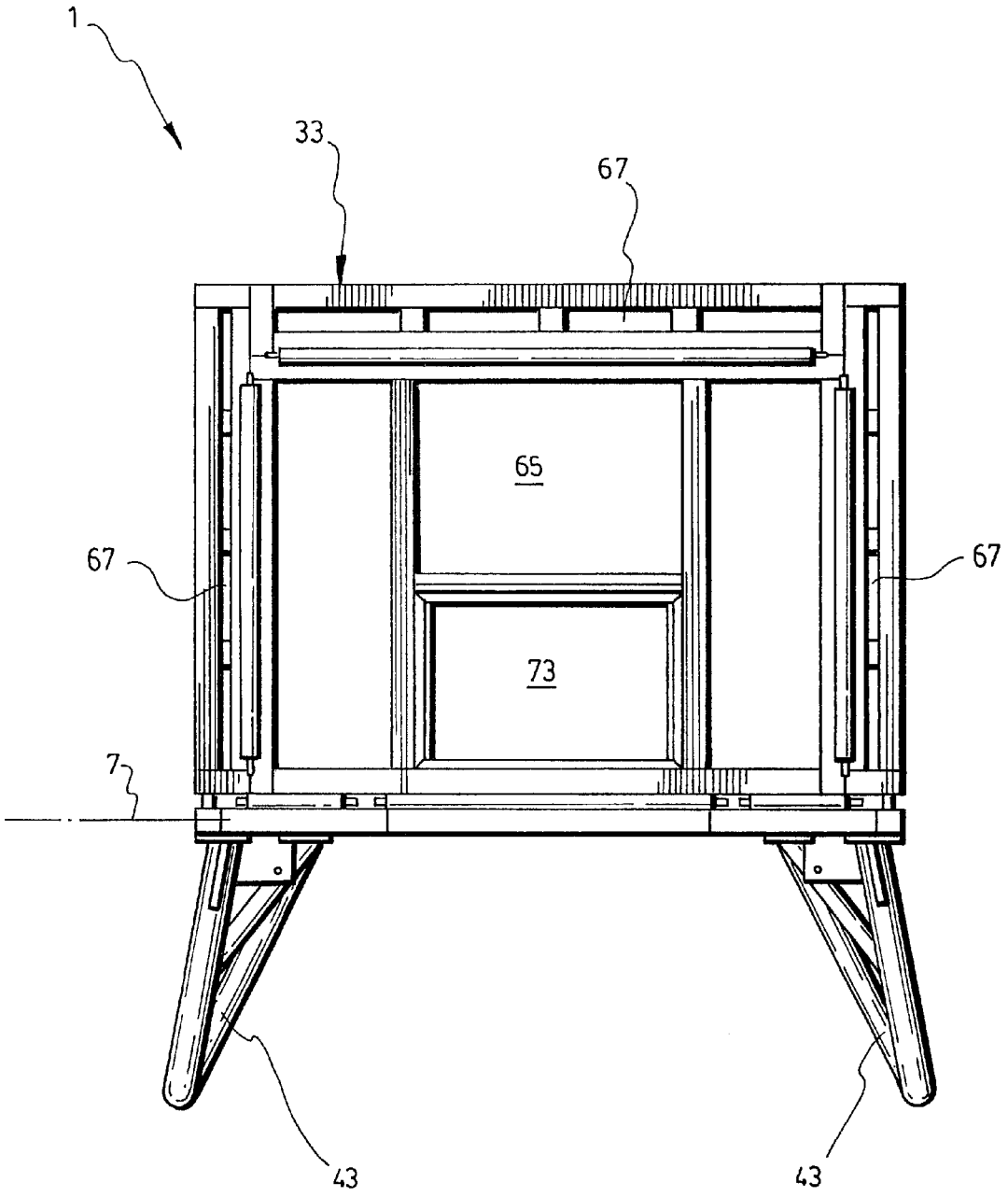
FIG. 6 is a front plan view of the sleigh-shaped device shown in FIG. 1.
Figure 7:
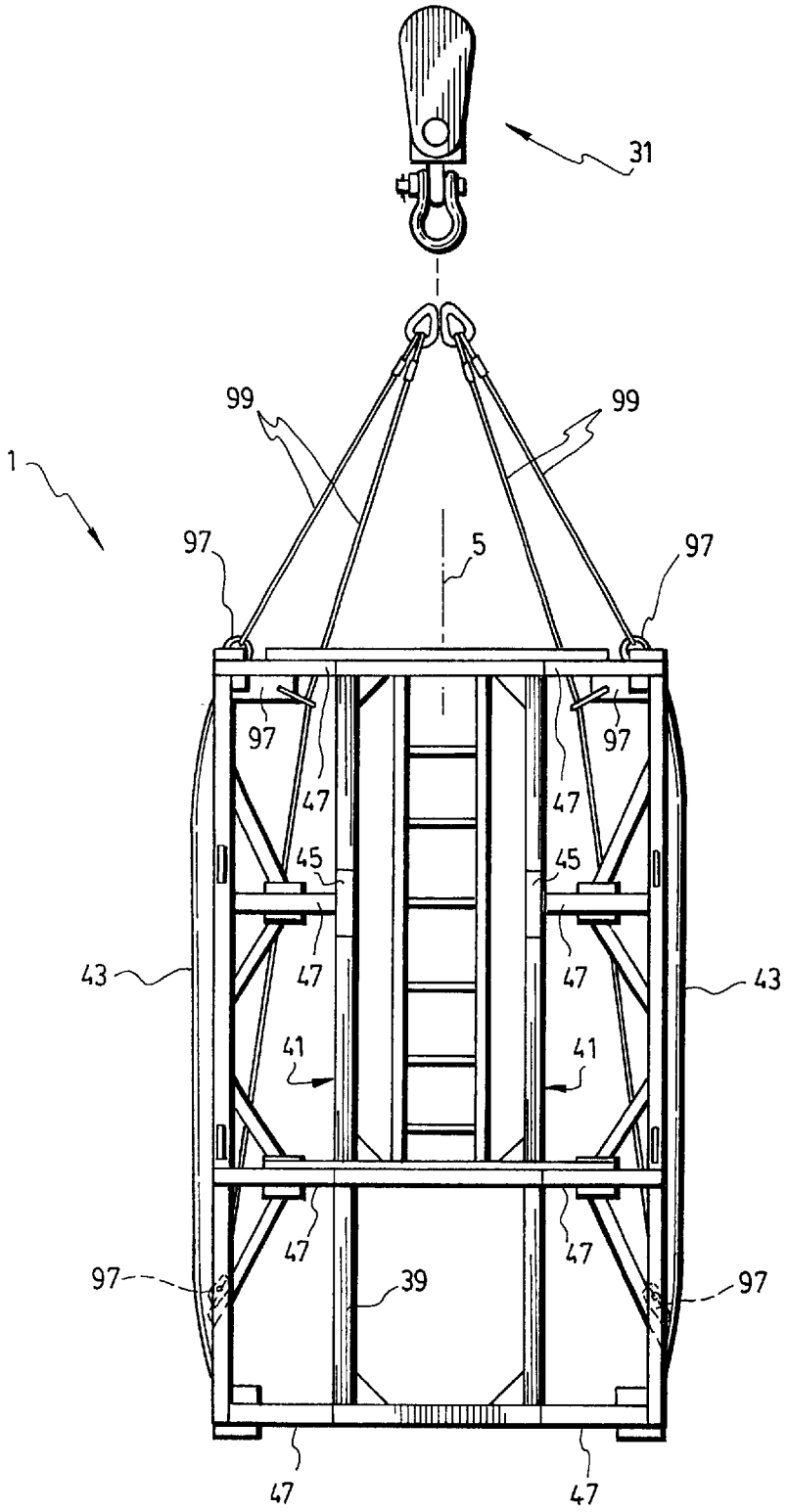
FIG. 7 is a top plan view of the sleigh-shaped device shown in FIG. 1, said device being shown with ropes hooked onto the hooks of the base frame of the device.
Figure 8:
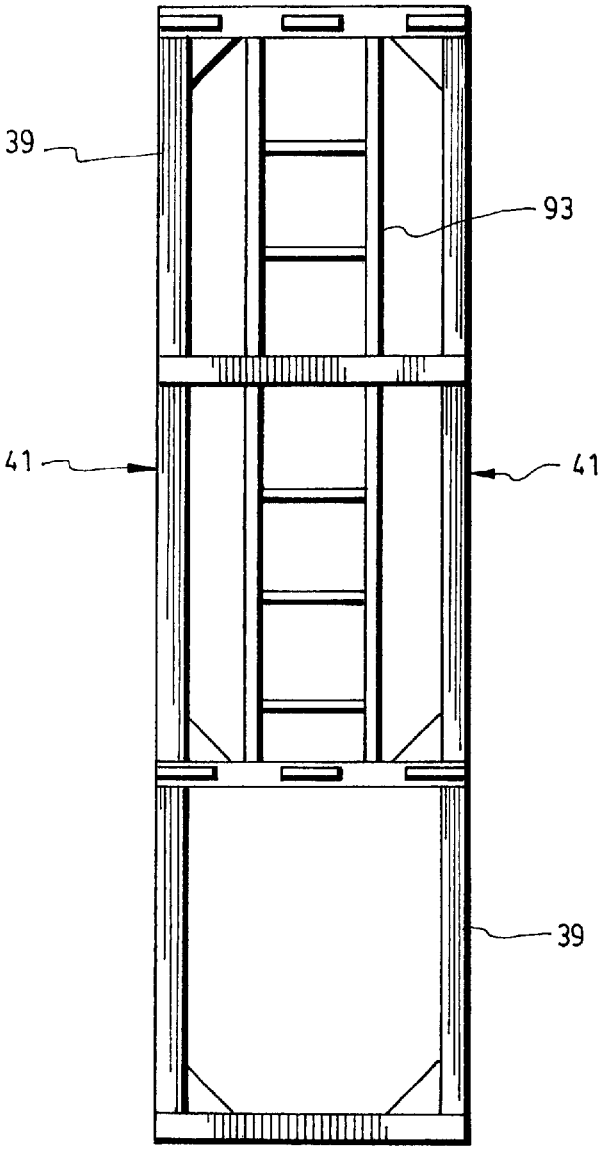
FIG. 8 is a top plan view of the central portion of the sleigh-shaped device shown in FIG. 1.
Figure 9:
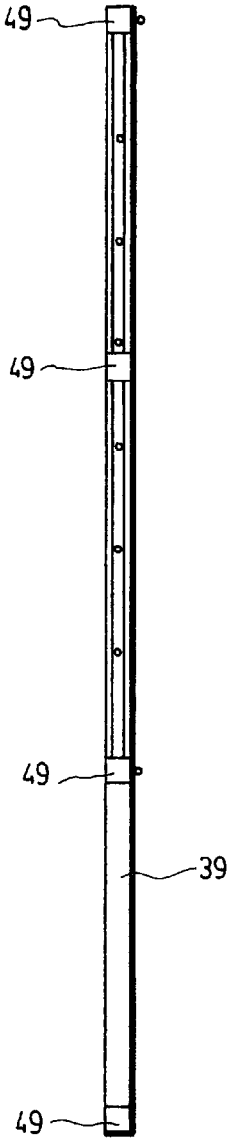
FIG. 9 is a side elevational view of the central portion of the sleigh-shaped device shown in FIG. 1.
Figure 10:
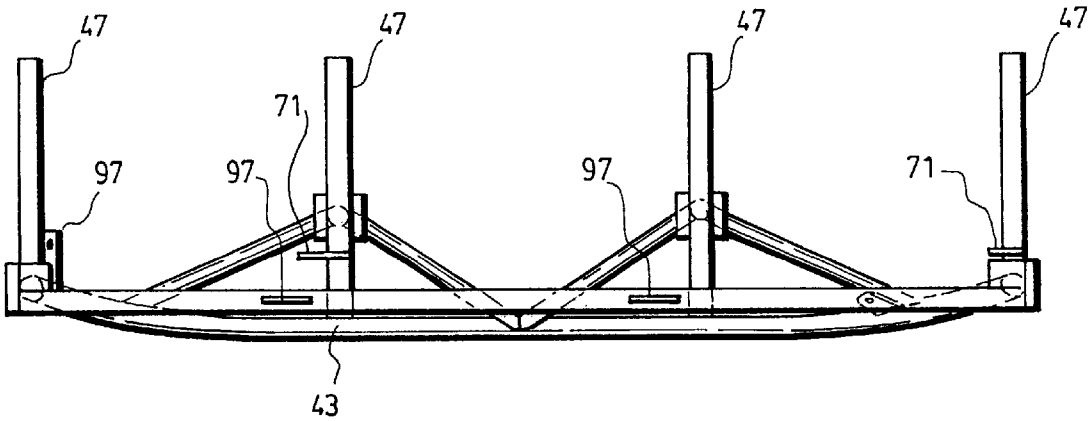
FIG. 10 is a top plan view of one of the two runners of the sleigh-shaped device shown in FIG. 1.
Figure 11:
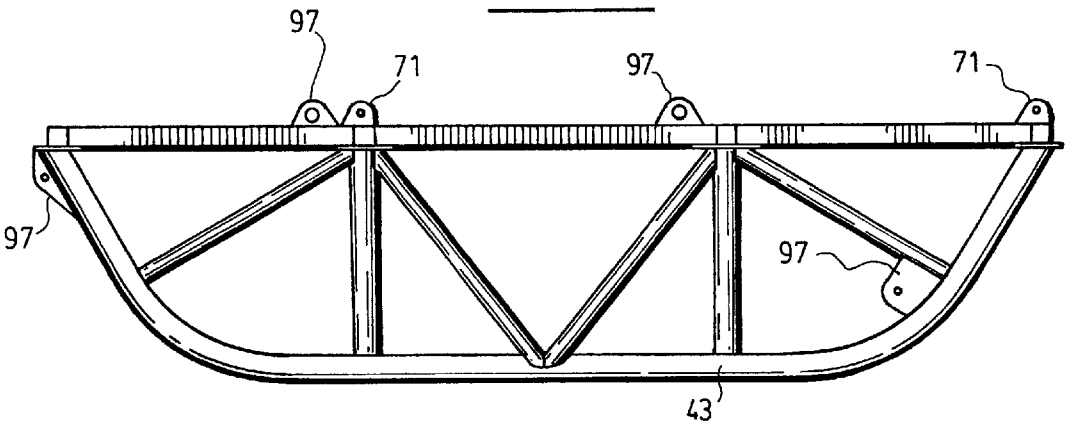
FIG. 11 is a side elevational view of one of the two runners of the sleigh-shaped device shown in FIG. 1.
Figure 12:
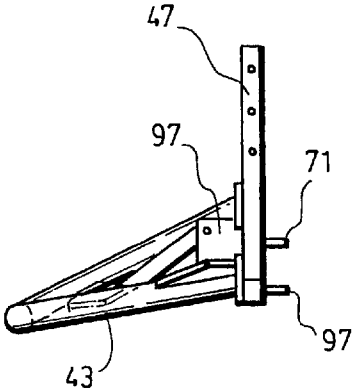
FIG. 12 is a rear plan view of one of the two runners of the sleigh-shaped device shown in FIG. 1.

As better shown in FIGS. 2 and 3, the sleigh-shaped device 1 preferably further comprises a tiltable safety roof 33 pivotably mounted to the top surface 21 of the base frame 9 between the rear end 25 and the tiltable platform 11 about a second axis 35 parallel to the transverse axis 7. Preferably also, the device 1 further comprises safety roof adjusting means 37 cooperating with the base frame 9 and the tiltable safety roof 33 for adjusting the tiltable safety roof 33 with respect to the base frame 9.

The tiltable safety roof 33 is primarily designed for protecting a user (not shown), working on the tiltable platform 11, from debris which may fall down the mining raise 3. Hence, the tiltable safety roof 33 acts primarily as a safety feature. However, it is worth noting that the tiltable safety roof 33 may fulfil other various purposes, such as lighting for example. That is, the tiltable safety roof 33 may be provided with lighting means for lighting the work area of the tiltable platform 11 so as to facilitate the work of a person who uses the device 1 and has to perform tasks along the mining raise 3. Moreover, the tiltable safety roof 33 may be used as a supervision platform by a second person, such as a foreman or a supervisor, to oversee and assist the work of a first person working on the tiltable platform 11. Thus, it is evident to a person skilled in the art that although the tiltable safety roof 33 is not an essential component of the invention for the proper operation thereof, such roof 33 offers substantial advantages and may take on various different embodiments depending on the application for which it is intended, given the fact that the usefulness of the tiltable safety roof 33 may be varied and diversified, as explained in the above-mentioned few examples.

As better shown in FIGS. 4 to 12, the base frame 9 preferably comprises a central portion 39 having two lateral sides 41 extending parallel to the longitudinal axis 5. The sliding means 19 also preferably comprises two runners 43 and runner adjusting means 45. As better shown in FIGS. 1 to 6, the two runners 43 preferably extend parallel to the longitudinal axis 5 and project from the bottom surface 17 of the base frame 9, the runners 43 being used for sliding along the mining raise 3 and being mounted onto the central portion 39 in such a manner so as to be transversally movable in position with respect to the same. Preferably, as better shown in FIGS. 10 to 12, the runners 43 have a truss body for greater structural rigidity, as apparent to a person skilled in the art. Preferably also, each runner 43 has projecting members 47 which slide into respective sleeves 49 of the corresponding lateral side 41 of the central portion 39, as better shown in FIGS. 8 and 9, so that each runner 43 is transversally movable in position, independently of the other runner 43, with respect to the central portion 39. The sleeves 49 are securely mounted onto the central portion 39 and can be made integral thereto. The runner adjusting means 45 are devised for adjusting the position of each runner 43 with respect to the central portion 39, so as to adjust the width of the base frame 9 according to a given cross-section of the mining raise 3. Hence, the runner adjusting means 45 preferably consist of any appropriate device for preventing relative movement of the projecting members 47 with respect to the sleeves 49, such as a clamp for example. The projecting members 47 of the runners 43 may be modified, i.e. provided with notches for example, so as to better cooperate with the runner adjusting means 45. Preferably also, the runners 43 are adjusted with respect to the central portion 39 so as to have a symmetric base frame 9 for better centrality and stability.

It is worth noting that although runners 43 are illustrated as the preferred embodiments for the sliding means 19 which are used for sliding along the mining raise 3, other embodiments could be used to facilitate movement of the device 1 along the mining raise 3, as is evident to a person skilled in the art. Thus, the word "sliding" or the expression "sliding means" 19 should not be interpreted in its restrictive sense. For example, the runners 43 could be provided with aligned wheels which facilitate "sliding" or "rolling" of the device 1 along the mining raise 3. Ski-shaped runners 43 could also be used for skidding along the mining raise 3. Furthermore, the above-mentioned or any other sliding means alternatives could be provided with damping mechanisms, such as shocks absorbers, to absorb and minimize vibrations of the device 1 as it passes over the irregularities of the mining raise 3. Hence, it is evident that other different kinds of sliding means 19 could be suitable for the device 1 as is apparent to a person skilled in the art. As a result, other kinds of runner adjusting means 45 may be used accordingly, as is also apparent to a person skilled in the art.

Figure 14:
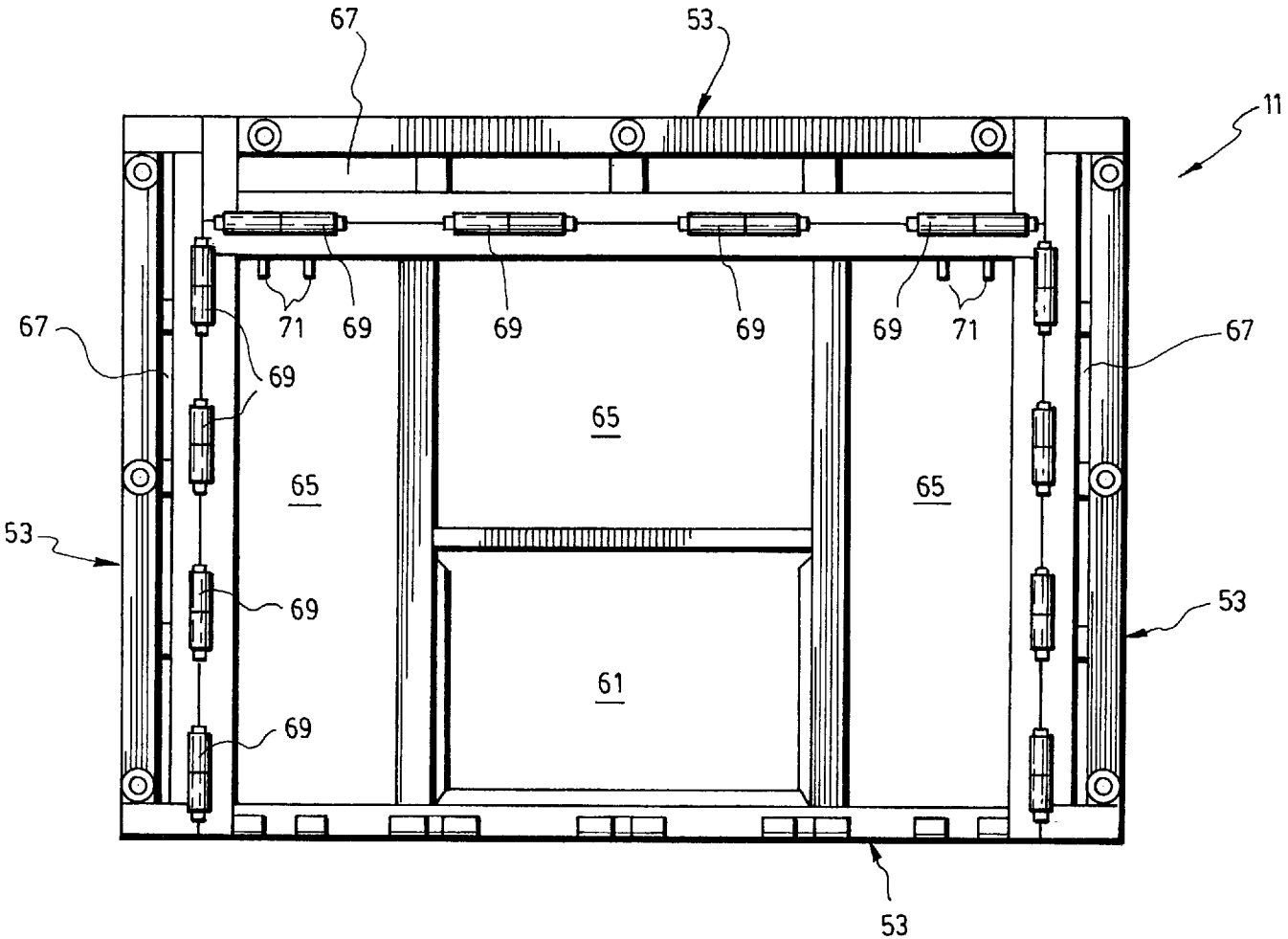
FIG. 14 is a top plan view of the platform of the sleigh-shaped device shown in FIG. 1.

As better shown in FIGS. 2, 3, and 14, the tiltable platform 11 is preferably in the form of a rectangular prism 51 comprising four lateral sides 53 and first and second opposite surfaces 55, 57. One of the lateral sides 53 is pivotally mounted to the top surface 21 of the base frame 9 by means of two hinges 59, each of these hinges 59 being securely fixed to one of the two runners 43. Preferably also, the device 1 further comprises a hatch 61 hingedly mounted to the tiltable platform 11, as better shown in FIGS. 2 and 14. The hatch 61 is devised to be removably opened and closed to give access to the user through the platform 11, and thus to give access down the mining raise 3 whenever required. Preferably, the platform adjusting means 13 may consist of two first telescopic arms 63, each of the first telescopic arms 63 having one end hingedly mounted to one of the two runners 43 and another end hingedly mounted to the second surface 57 of the tiltable platform 11, whereby extension or compression of the first telescopic arms 63 allows the tiltable platform 11 to be adjusted with respect to the base frame 9, as better shown in FIGS. 2 and 3.

As better shown in FIG. 14, the tiltable platform 11 preferably comprises a main section 65 and sub-sections 67 removably fixed thereon in a same plane, preferably by means of hinges 69, so as to form the rectangular prism 51. Sub-sections 67 of different and appropriate dimensions are removably mounted onto the main section 65 so as to vary the length and width of the tiltable platform 11, depending on the geometric configurations of the mining raise 3 and on the width of the base frame 9, as apparent to a person skilled in the art. The main section 65 is preferably pivotally mounted to the top surface 21 of the base frame 9 by means of two hinges 59. Preferably also, the corresponding ends of the first telescopic arms 63 are hingedly mounted to the second surface 57 of the tiltable platform 11 through connection plates 71 which are preferably securely fixed onto the main section 65 of the tiltable platform 11, as also better shown in FIG. 14. Other connection plates 71 are also preferably securely mounted onto the runners 43 for hingedly mounting the other corresponding ends of the first telescopic arms 63 onto the base frame 9.

It is worth noting that other kinds of main section 65, sub-sections 67, and co-operation means 69 thereinbetween may be suitable for the invention, as apparent to a person skilled in the art, so as to impart to the tiltable platform 11 adjustable features in terms of length and width, without departing from the scope of the present invention.

As can be easily understood for the aforementioned and the accompanying drawings, the pivotally mounted tiltable platform 11 and the platform adjusting means 13 make it possible to adjustably provide a levelled working surface, i.e. the platform 11, irrespectively of the dipping angle of the mining raise 3.

As better shown in FIGS. 2, 3 and 14, the tiltable safety roof 33 is preferably in the form of a rectangular prism 51 comprising four lateral sides 53 and first and second opposite surfaces 55, 57. One of the lateral sides 53 is pivotally mounted to the top surface 21 of the base frame by means of two hinges 59, each of these hinges 59 being securely fixed to one of the two runners 43. Please note that FIG. 14 illustrates both the tiltable platform 11 and the tiltable safety roof 33 of the preferred embodiment of the invention. Preferably, the device 1 further comprises a hatch 73 hingedly mounted to the tiltable safety roof 33, as better shown in FIGS. 2 and 14, the hatch 73 being devised to be removably opened and closed to allow a user to have access through the roof 33, so as to be able to go back up the mining raise 3. Preferably also, the safety roof adjusting means 37 consists of two second telescopic arms 75, each of said second telescopic arms 75 having one end hingedly mounted to one of the two runners 43 and another end hingedly mounted to the second surface 57 of the tiltable safety roof 33, whereby extension or compression of said second telescopic arms 75 allows the tiltable safety roof 33 to be adjusted with respect to the base frame 9, as better shown in FIGS. 2 and 3.

It can be easily understood that, like in the case of the platform 11, the pivotally mounted tiltable safety roof 33 together with the safety roof adjusting means 37 provide another levelled surface, i.e. the safety roof 33, irrespectively of the dipping angle of the mining raise 3. In fact, another advantage of the tiltable safety roof 33, is that it can be adjusted appropriately slightly slanted so that debris falling from the top of the mining raise 3 and landing on the slanted safety roof 33 can trickle down the same, due to the slant and because of gravity, and fall between the two runners 43 through the safety fence 77. As a result, there is no accumulation of debris on the safety roof 33. Hence, due to the lack of debris accumulation on the safety roof 33, the device 1 is structurally safer because less weight is supported. Furthermore, also because of the lack of debris accumulation on the safety roof 33, the worker can open the hatch 73 of the safety roof 33 more easily and safely either when the latter is still in an appropriate slanted manner or brought back to a levelled position.

As better shown in FIGS. 2 and 3, the first surface 55 of the tiltable platform 11 is preferably provided with a tool 79 for carrying out work in the mining raise 3. The tool 79 is preferably mounted on an ergonomic support 81, and the ergonomic support 81 is preferably devised to be removably secured to the first surface 55 of the platform 11. Preferably also, the ergonomic support 81 comprises a cylindrical bar 83, that is parallel to the transverse axis 7 of the base frame 9 and comprises a sleeve 85 slidably and coaxially mounted thereon, the tool 79 being securely fixed onto the sleeve 85 so that the user using the tool 79 in conjunction with the ergonomic support 81 and the pulley system 31 which provides movement of the sleigh-shaped device 1 along the mining raise 3, can work along three degrees of freedom in the mining raise 3. The tool 79 is preferably a drill.

As better shown in FIGS. 2 and 3, the sleigh-shaped device 1 preferably comprises also a tiltable safety fence 77 pivotally mounted to the bottom surface 17 of the base frame 9 between the two runners 43 about a third axis 87 parallel to the transverse axis 7. Preferably also, the device 1 may further comprises safety fence adjusting means 89 cooperating with the base frame 9 and the tiltable safety fence 77 for adjusting the tiltable safety fence 77 with respect to the base frame 9. The tiltable safety fence 77 preferably consists of a gridded prism comprising lateral sides and first and second opposite surfaces, one of the lateral sides being pivotally mounted to the bottom surface 17 of the base frame 9 by means of at least one hinge, that is securely fixed to the central portion 39. Preferably also, the safety fence adjusting means 89 consists of two third telescopic arms 91, each of the third telescopic arms 91 having one end hingedly mounted to the central portion 39 and another end hingedly mounted to the second surface of the tiltable safety fence 77, whereby extension or compression of the third telescopic arms 91 allows the tiltable safety fence 77 to be adjusted with respect to the base frame 9.

The gridded prism is preferably designed to allow debris, either falling from above the device 1 or accumulated from the work on the platform 11, to pass therethrough. Most importantly, the gridded prism also prevents a worker operating on the tiltable platform 11 from falling between the runners 43. Hence, the gridded prism is another important safety feature of the device 1.

As better shown in FIGS. 2, 3, 4, 7 and 8, the central portion 39 of the base frame 9 is provided with a ladder 93 extending along the longitudinal axis 5 for allowing the user to move from the first surface 55 of the platform 11 to the first surface 55 of the safety roof 33 through the roof hatch 73, and vice-versa.

Figure 13:
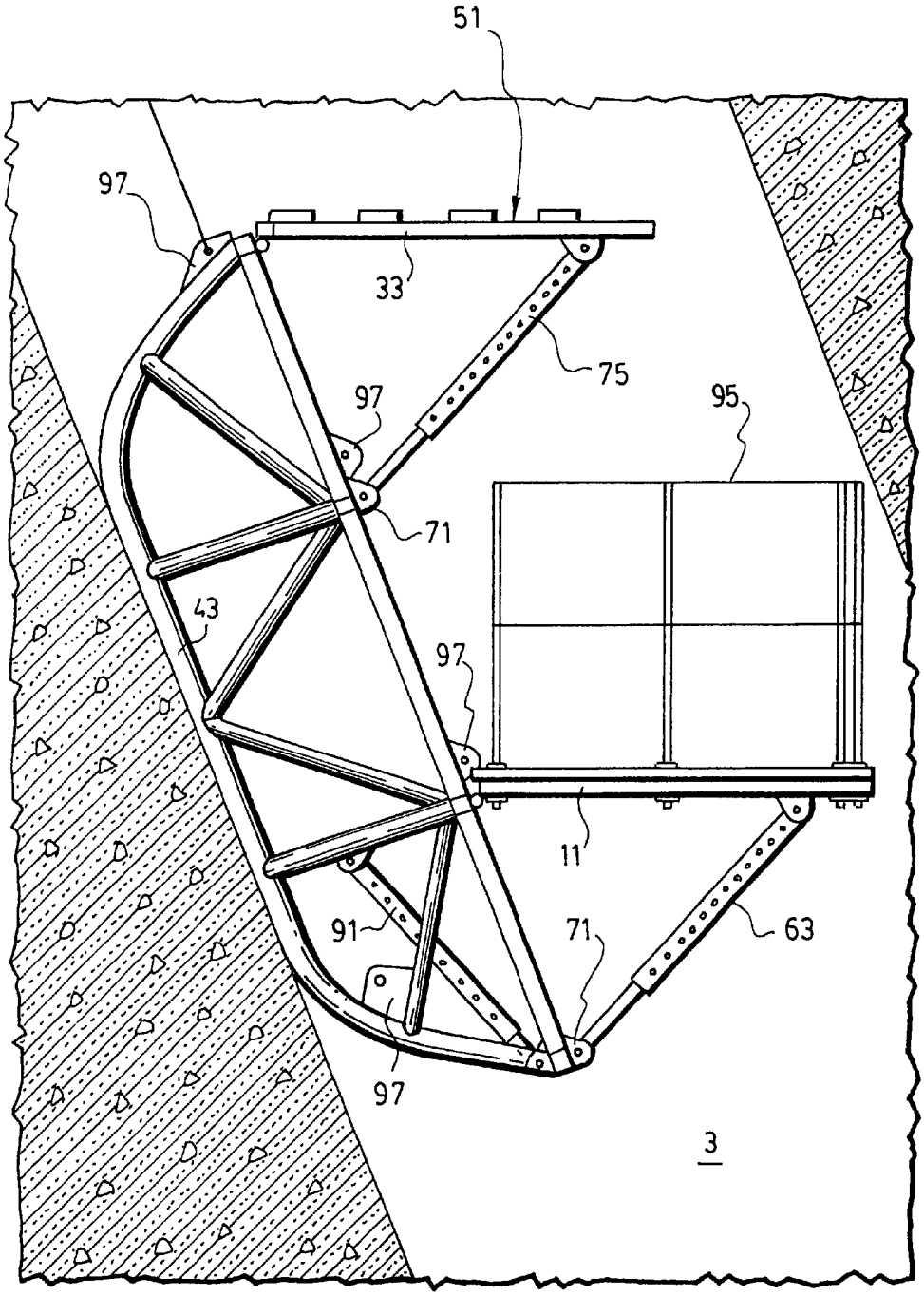
FIG. 13 is a side view similar to the one of FIG. 1, wherein the sleigh-shaped device is shown with a safety railing.

As better shown in FIG. 13, the tiltable platform 11 is preferably provided also with a safety railing 95 projecting perpendicularly from the first surface 55 of the platform 11 and extending along a portion of the periphery of said top surface 55. The safety railing 95 is also a substantial safety feature.

As better in shown in FIGS. 1, 2, 3, 5, 11, and 13, the connection means 15 which are devised for anchoring the base frame 9 to the pulley system 31, preferably consists of hooks 97 attached to the runners 43 for hooking thereto ropes 99 leading to the pulley system 31 which, as aforementioned, provides the movement of the sleigh-shaped device 1 along the mining raise 3, as better shown in FIG. 1.

It is worth noting that the hooks 97 may be provided on other appropriate locations of the device 1, as is evident to a person skilled in the art, depending on the applications for which the device 1 is intended for. Furthermore, as shown in FIG. 1, anchoring ropes 101 of an appropriate elasticity and slack can also be attached to the device 1 as a backup safety feature for when a failure should occur with the pulley system 31.

According to the present invention, the mining raise 3 is excavated in a continuous process to open a first hole along the projected raise 3. Then, long holes blasting are used to bring the raise cross-section to the desired dimensions. Once the excavation is done, the sleigh-shaped device 1 is used to proceed to the various tasks required to finish the mining raise 3 for its intended purpose. These tasks may include one or more of the following steps: scaling of the rock walls; rock bolting; installation of rails; installation of screens; covering the walls with shot-creet; installation of cables, duct or various utilities; installation of ladders and guards; etc.

As may now be better appreciated, the present invention is a substantial improvement over the known devices used in mining raises 3. For instance, unlike most of the devices known in the art which are designed for being used from the bottom of the raise 3 and from moving upwards therein, the present invention can be lowered into the raise 3 by a pulley system 31 for enabling top to bottom sequence of work along the raise 3. In this manner, the present invention offers several significant safety advantages over the prior art. Firstly, the workmen using the sleigh-shaped device 1 are never exposed to unsecured ground during their work as in the case of the Alimak™ raise climber and/or the scaffolding construction. Secondly, since the access is from the top with a lowering device, such as a ladder for example, installed as the work proceeds, worker supervision by a foreman becomes possible, a feature that no other system on the market offers. These two advantages, among many others explained herein, constitute a significant work safety improvement over the systems known in the art.

Another substantial improvement of the present invention over the devices known in the art, is that the device 1 according to the present invention comprises various adjustable features enabling it to adapt itself to the particular geometric configurations of various types of mining raises 3. As explained hereinabove, the device 1 is designed so that the runner adjusting means 45 can adjust the position of each runner 43 with respect to the central portion 39 so as to adjust the width of the base frame 9 according to a given cross-section of the mining raise 3. Furthermore, the tiltable platform 11, the safety roof 33 and the safety fence 77 may be pivotally and dimensionally adjusted with respect to the base frame 9 according to a particular dipping angle of the mining raise 3. Such ensures, among other things, that the workmen always stand on a levelled working surface. Hence, the present invention can adapt itself to various shapes and sizes of different mining raises 3 because of its telescopic and adjustable structural elements.

Another important advantage of the present invention is that it offers a newer and safer approach to working in mining raises 3 and comprises various safety features in order to not only provide better performance, but also greater safety to its users. Indeed, a comprehensive ergonomic study was conducted in order to design the present invention and several new features were introduced in order to improve the safety of the present sleigh-shaped device 1. These features include:

a new drill stand structure, referred to previously as the ergonomic support 81, which can be attached to the platform 11, and whose design permits full rotation freedom which allows tool operation, such as drilling for example, in any direction required and the worker does not need to exert any force to lift or maintain the tool;

a work surface 55 covered with damping material to minimize vibrations and sound reverberations;

a safety roof 33 offering complete protection from falling objects or debris;

a safety railing 95 and a safety fence 77 protecting from accidental falls from the sides or between the runners 43;

a double anchorage system with anchoring ropes 101 also called "damping springs" as a fail-safe to the main hoist cable of the pulley system 31;

lateral adjustable telescopic arms 63 to prevent lateral vibrations or movements of the platform 11 during tool operation;

a retractable seat (not shown), provided on the platform 11, that can be used during tool operations providing less stressful positions to the workers for the tasks operations;

a specially designed telescopic structure of the base frame 9 permitting adjustment for cross-section size variations;

a specific skid design of the runners 43 to ensure that the device 1 will slide and maintain itself in a centralized position, thus ensuring proper spacing at all times between the device sides and the rock faces of the raise 3; and specifically designed tools and materials racks integrated to the device 1 respecting recommendations from an ergonomic study.

Furthermore, the sleigh-shaped device 1 according to the present invention as described earlier, is a device which not only gives access to the rock face of the mining raise 3, but which also comprises, as aforementioned, an ergonomic stand structure allowing a user to operate a tool 79 for carrying out tasks along the raise 3 with little effort.

Moreover, the sleigh-shaped device 1 according to the present invention comprises a relatively simple design and is relatively lightweight, thereby making it easier to manufacture, assemble, maintain, repair and/or move around.

Hence, the main advantages of the present invention when compared to other systems known in the art, are:

the telescopic adjustable features of the sleigh-shaped device 1 that makes it adjustable to the particular geometric configurations of various types of mining raises 3;

the special geometry of the runners 43 of the base frame 9 that insure proper positioning of the device 1 in the mining raise 3 despite rock irregularities in the walls;

the ergonomic support 81 structure attached to the platform 11 that allows any orientation of tool operation with very little physical effort from the worker; and the cables and hoist system of the pulley system 31 allowing top to bottom sequence of work.

It is to be understood that the device according to the present invention could potentially be used in other fields, with people having different trades, such as in mountain climbing for example. The device according to the present invention may also be used with automated equipments, instead of human beings, to carry out the tasks in the mining raise 3.

Of course, numerous modifications could be made to the above-described embodiments without departing from the scope of the invention as defined in the appended claims.

What is claimed is:

1. A sleigh-like device for use in a mining raise, said sleigh-like device having a longitudinal axis and a transverse axis, said sleigh-like device comprising:

a base frame for sliding along the mining raise in a direction parallel to the longitudinal axis, said base frame having a bottom surface with sliding means extending parallel to the longitudinal axis, a top surface having front and rear opposite ends, and a central portion having two lateral sides extending parallel to the longitudinal axis, the sliding means of the base frame comprising:

two runners extending parallel to the longitudinal axis and projecting from the bottom surface of the base frame, said runners being used for sliding along the mining raise and being mounted onto the central portion in such a manner so as to be transversely movable in position with respect to the same; and runner adjusting means for adjusting the position of each runner with respect to the central portion so as to adjust the width of the base frame according to a given cross-section of the mining raise;

a tiltable platform pivotally mounted to the top surface of the base frame between the front and rear ends about a first axis parallel to the transverse axis;

platform adjusting means cooperating with the base frame and the tiltable platform for adjusting said tiltable platform with respect to the base frame; and connecting means for anchoring the base frame to a pulley system to provide movement of the sleigh-like device along the mining raise, the front end of the base frame extending below the rear end of the same during movement of the sleigh-shaped device along said mining raise.

2. The sleigh-like device according to claim 1, further comprising:

a tiltable safety roof pivotally mounted to the top surface of the base frame between the rear end and the tiltable platform about a second axis parallel to the transverse axis, and safety roof adjusting means cooperating with the base frame and the tiltable safety roof for adjusting said tiltable safety roof with respect to the base frame.

3. The sleigh-like device according to claim 2, wherein the tiltable safety roof consists of a rectangular prism comprising four lateral sides and first and second opposite surfaces, one of said lateral sides being pivotally mounted to the top surface of the base frame by means of two hinges, each of said two hinges being securely fixed to a respective one of the two runners.

4. The sleigh-like device according to claim 3, wherein the safety roof adjusting means consists of two second telescopic arms, each of said second telescopic arms having one end hingedly mounted to one of the two runners and another end hingedly mounted to the second surface of the tiltable safety roof, whereby extension or compression of said second telescopic arms allows the tiltable safety roof to be adjusted with respect to the base frame.

5. The sleigh-like device according to claim 2, further comprising a hatch hingedly mounted to the tiltable safety roof, said hatch being devised to be removably opened and closed to allow a user to have access through the roof.

6. The sleigh-like device according to claim 5, wherein the central portion of the base frame is provided with a ladder extending along the longitudinal axis for allowing the user to move from a first surface of the platform to a first surface of the roof through the roof hatch, and vice versa.

7. The sleigh-like device according to claim 1, further comprising:

a tiltable safety fence pivotally mounted to the bottom surface of the base frame between the two runners about a third axis parallel to the transverse axis; and safety fence adjusting means cooperating with the base frame and the tiltable safety fence for adjusting said tiltable safety fence with respect to the base frame.

8. The sleigh-like device according to claim 7, wherein the tiltable safety fence consists of a gridded prism comprising lateral sides and first and second opposite surfaces, one of said lateral sides being pivotally mounted to the bottom surface of the base frame by means of at least one hinge, said at least one hinge being securely fixed to the central portion.

9. The sleigh-like device according to claim 8, wherein the safety fence adjusting means consists of two third telescopic arms, each of said third telescopic arms having one end hingedly mounted to the central portion and another end hingedly mounted to the second surface of the tiltable safety fence, whereby extension or compression of said third telescopic arms allows the tiltable safety fence to be adjusted with respect to the base frame.

10. The sleigh-like device according to claim 1, wherein the tiltable platform consists of a rectangular prism comprising four lateral sides and first and second opposite surfaces, one of said lateral sides being pivotally mounted to the top surface of the base frame by means of two hinges, each of said two hinges being securely fixed to a respective one of the two runners.

11. The sleigh-like device according to claim 10, wherein the platform adjusting means consists of two first telescopic arms, each of said first telescopic arms having one end hingedly mounted to one of the two runners and another end hingedly mounted to the second surface of the tiltable platform, whereby extension or compression of said first telescopic arms allows the tiltable platform to be adjusted with respect to the base frame.

12. The sleigh-like device according to claim 10, wherein the tiltable platform is provided with a safety railing projecting perpendicularly from the first surface of the platform and extending along a portion of the periphery of said top surface.

13. The sleigh-like device according to claim 10, wherein the first surface of the tiltable platform is provided with a tool for carrying out work in the mining raise, said tool being mounted on an ergonomic support, said ergonomic support being removably secured to the first surface of the platform.

14. The sleigh-like device according to claim 13, wherein the ergonomic support comprises a cylindrical bar, said bar being parallel to the transverse axis of the base frame and comprising a sleeve slidably and coaxially mounted thereon, the tool being securely fixed onto the sleeve so that a user using the tool in conjunction with the ergonomic support and the pulley system which provides movement of the sleigh-like device along the mining raise, is enabled to work along three degrees of freedom in the mining raise.

15. The sleigh-like device according to claim 14, wherein the tool is a drill.

16. The sleigh-like device according to claim 1, further comprising a hatch hingedly mounted to the tiltable platform, said hatch being devised to be removably opened and closed to allow a user to have access through the platform.

17. The sleigh-like device according to claim 1, wherein said connection means consists of hooks attached to the runners for hooking thereto ropes leading to the pulley system which provides the movement of the sleigh-shaped device along the mining raise.

* * * * *